US010414990B1

(12) United States Patent
Sachan et al.

(10) Patent No.: US 10,414,990 B1
(45) Date of Patent: Sep. 17, 2019

(54) PROCESSES FOR ISOMERIZING HYDROCARBONS

(71) Applicant: UOP LLC, Des Plaines, IL (US)

(72) Inventors: Rohit Sachan, Haryana (IN); Manoj Kumar, Haryana (IN)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/970,717

(22) Filed: May 3, 2018

(51) Int. Cl.
*C10G 65/04* (2006.01)
*C10G 45/58* (2006.01)

(52) U.S. Cl.
CPC ..... *C10G 65/043* (2013.01); *C10G 45/58* (2013.01)

(58) Field of Classification Search
None
See application file for complete search history.

(56) References Cited

U.S. PATENT DOCUMENTS 3,706,655 A * 12/1972 Weith ..... C10G 69/02 208/101
7,223,898 B2 5/2007 Rice
8,808,534 B2 * 8/2014 Ercan ..... C10G 59/06 208/133
2013/0096356 A1 * 4/2013 Bharuka ..... C07C 9/14 585/317
2015/0175505 A1 * 6/2015 Glover ..... C10G 45/58 585/738

* cited by examiner

*Primary Examiner* — Philip Y Louie
*Assistant Examiner* — Alyssa L Cepluch

(57) ABSTRACT

Processes and apparatus for isomerizing hydrocarbons are provided. The process comprises isomerizing the hydrocarbon feed stream in the presence of an isomerization catalyst and hydrogen in an isomerization zone under isomerization conditions to produce an isomerized stream. The isomerized stream is stabilized in a stabilizer column to provide a stabilizer off-gas stream and a liquid isomerate stream. The stabilizer off gas stream is passed to a net-gas scrubber to obtain a net gas scrubber off-gas stream comprising hydrogen and $C_1$-$C_4$ hydrocarbons. The net gas scrubber off-gas stream is contacted with an absorber liquid feed comprising $C_5$ to $C_7$ hydrocarbons in an absorber column to provide an absorber overhead stream comprising predominantly hydrogen and an absorber bottoms stream comprising predominantly light ends, the light ends comprising $C_1$-$C_4$ hydrocarbons. The absorber overhead stream is passed to the isomerization zone as make-up hydrogen.

18 Claims, 2 Drawing Sheets

PROCESSES FOR ISOMERIZING HYDROCARBONS

FIELD

The subject matter of the present disclosure generally relates to processes and apparatuses for isomerizing hydrocarbons. More particularly, the technical field relates to increasing hydrogen recovery in processes for isomerizing hydrocarbons.

BACKGROUND

Hydrocarbon streams are refined through various unit operations to produce various types of fuel, industrial raw materials that are employed in production of other compounds or products, and petroleum-based products. Production of gasoline is a particularly important industrial process involving refining of hydrocarbons through various unit operations, including isomerization and catalytic reforming. Reforming of hydrocarbons is useful to convert paraffins to aromatic compounds in the presence of noble metal catalysts. Aromatic compounds provide high octane value and, thus, are desirable components in gasoline. Isomerization is effective to convert linear hydrocarbons into branched hydrocarbons, which have a higher octane value than linear compounds but a lower octane value than aromatic compounds. Isomerized streams (or isomerate) are substantially free of aromatic compounds, whereas reformate streams (or reformate) generally include high quantities of aromatic compounds (e.g., at least 50 wt %).

During refining, a hydrocarbon stream is generally separated into various streams based on the number of carbon atoms of compounds within each stream. Hydrocarbons having 7 or more carbon atoms are generally subject to reforming because reforming generally results in higher octane value than isomerization of these hydrocarbons. Hydrocarbons having 5 or 6 carbon atoms are generally subjected to an isomerization process which has significant hydrogen requirements.

Hydrogen is an expensive commodity. The efficient use of hydrogen is very important to the economics of an isomerization process. In current designs of isomerization units, there is a significant amount of hydrogen that is currently not being recovered, such as the hydrogen that ends up in scrubber off-gas.

Accordingly, it is desirable to provide apparatuses and processes to economically recover hydrogen and to reduce the amount of makeup hydrogen that would be required in a $C_5/C_6$ isomerization unit, thus reducing the operating cost associated with producing the hydrogen. Further, it is desirable for increased recovery of $C_3$-$C_4$ hydrocarbons such as liquefied petroleum gas (LPG) from the scrubber off-gas. Furthermore, other desirable features and characteristics of the present subject matter will become apparent from the subsequent detailed description of the subject matter and the appended claims, taken in conjunction with the accompanying drawings and this background of the subject matter.

SUMMARY

Various embodiments contemplated herein relate to processes and apparatuses for isomerizing hydrocarbons. The exemplary embodiments taught herein achieve increased hydrogen recovery in processes and apparatuses for isomerizing hydrocarbons.

In accordance with an exemplary embodiment, a process is provided for isomerizing a hydrocarbon feed stream comprising at least one of $C_5$ to $C_7$ hydrocarbons. The process comprises isomerizing the hydrocarbon feed stream in the presence of an isomerization catalyst and hydrogen in an isomerization zone under isomerization conditions to produce an isomerized stream. The isomerized stream is stabilized in a stabilizer column to provide a stabilizer off-gas stream and a liquid isomerate stream. The stabilizer off gas stream is passed to a net-gas scrubber to obtain a net gas scrubber off-gas stream comprising hydrogen and $C_1$-$C_4$ hydrocarbons. The net gas scrubber off-gas stream is contacted with an absorber liquid feed comprising $C_5$ to $C_7$ hydrocarbons in an absorber column to provide an absorber overhead stream comprising predominantly hydrogen and an absorber bottoms stream comprising predominantly light ends, the light ends comprising $C_1$-$C_4$ hydrocarbons. The absorber overhead stream is passed to the isomerization zone as make-up hydrogen.

In accordance with another exemplary embodiment, a process is provided for isomerizing a light naphtha stream. The process comprises passing the light naphtha stream to a light naphtha hydrotreating unit to obtain a hydrotreating effluent. The hydrotreating effluent is passed to a stripper to provide a stripper overhead stream comprising light ends and a stripper bottoms stream comprising $C_5$-$C_7$ hydrocarbons. A first portion of the stripper bottoms stream is isomerized in the presence of an isomerization catalyst and hydrogen in an isomerization zone under isomerization conditions to produce an isomerized stream. The isomerized stream is stabilized in a stabilizer column to provide a stabilizer off-gas stream and a liquid isomerate stream. The stabilizer off gas stream is passed to a net-gas scrubber to obtain a net gas scrubber off-gas stream comprising hydrogen and $C_1$-$C_4$ hydrocarbons. The net gas scrubber off-gas stream is contacted with a second portion of the stripper bottoms stream in an absorber column to provide an absorber overhead stream comprising predominantly hydrogen and an absorber bottoms stream comprising light ends. The absorber overhead stream is passed to the isomerization zone as make-up hydrogen.

In accordance with yet another exemplary embodiment, a process is provided for isomerizing a straight run naphtha stream. The process comprises passing a straight run naphtha feed to a straight run naphtha hydrotreating unit to provide a heavy naphtha hydrotreating effluent. The straight run naphtha hydrotreating effluent is passed to a stripper to provide a stripper overhead stream comprising light ends and a stripper bottoms comprising $C_5$-$C_7$ and $C_{7+}$ hydrocarbons. A first portion of the stripper bottoms stream is passed to a naphtha splitter column to provide a hydrocarbon feed stream comprising $C_5$-$C_7$ hydrocarbons and a $C_{7+}$ hydrocarbon stream. The hydrocarbon feed stream is isomerized in the presence of an isomerization catalyst and hydrogen in an isomerization zone under isomerization conditions to produce an isomerized stream. The isomerized stream is stabilized in a stabilizer column to provide a stabilizer off-gas stream and a liquid isomerate stream. The stabilizer off gas stream is passed to a net-gas scrubber to obtain a net gas scrubber off-gas stream comprising hydrogen and $C_1$-$C_4$ hydrocarbons. The net gas scrubber off-gas stream is contacted with a second portion of the stripper bottoms stream in an absorber column to provide an absorber overhead stream comprising predominantly hydrogen and an absorber bottoms stream comprising light ends. The absorber overhead stream is passed to the isomerization zone as make-up hydrogen.

The disclosed subject matter allows recovery of about 80 to about 98% of hydrogen from the scrubber off-gas going to the fuel gas header in an isomerization process and reduces the makeup hydrogen consumption in the process.

These and other features, aspects, and advantages of the present disclosure will become better understood upon consideration of the following detailed description, drawing and appended claims.

BRIEF DESCRIPTION OF THE DRAWINGS

The various embodiments will hereinafter be described in conjunction with the following drawing figures, wherein like numerals denote like elements, and wherein.

Figure 1:
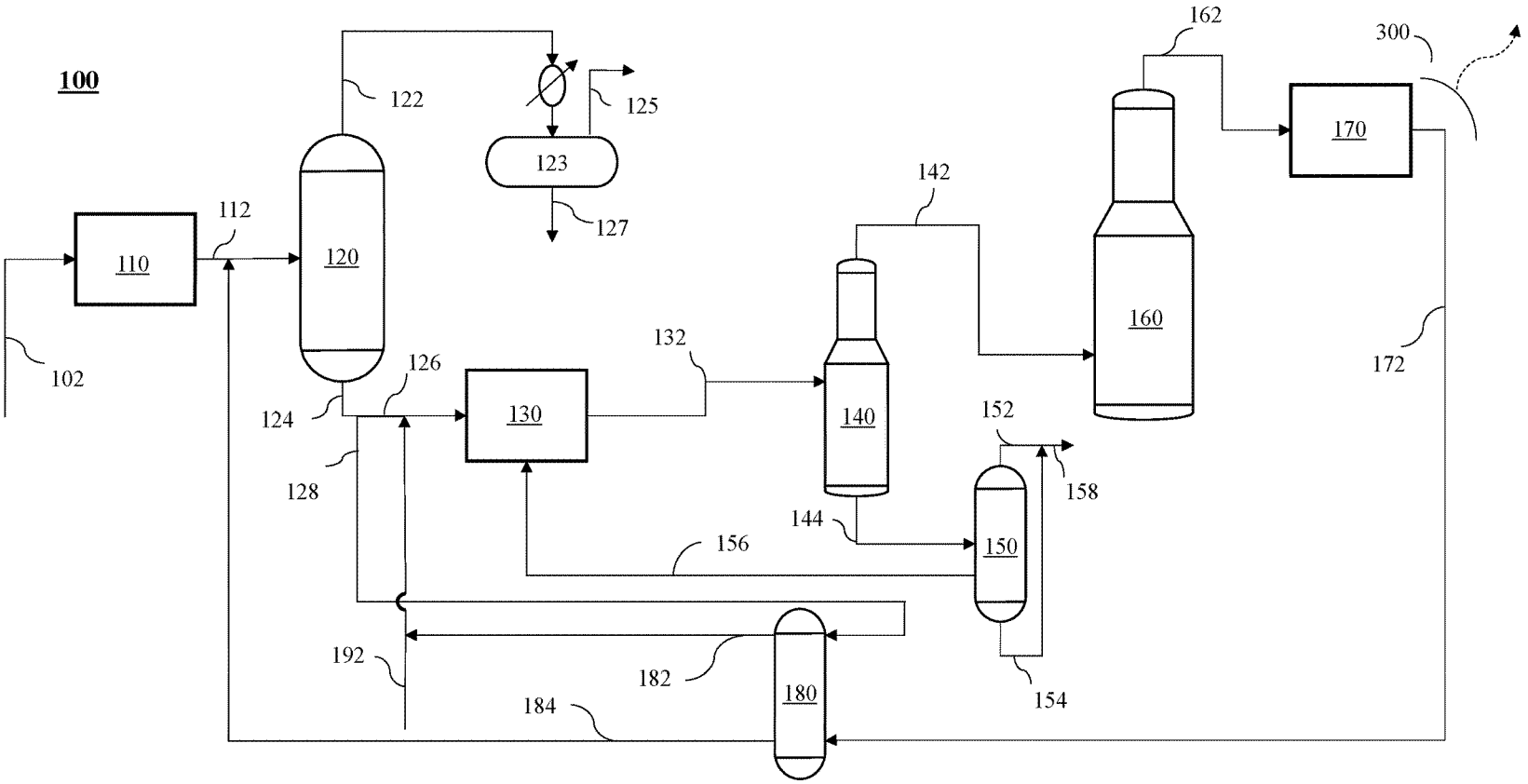
FIG. 1 is a schematic diagram of a process and an apparatus for isomerizing hydrocarbons in accordance with an exemplary embodiment.

Skilled artisans will appreciate that elements in the FIGURES are illustrated for simplicity and clarity and have not necessarily been drawn to scale. For example, the dimensions of some of the elements in the FIGURES may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

The following detailed description is merely exemplary in nature and is not intended to limit the various embodiments or the application and uses thereof. Furthermore, there is no intention to be bound by any theory presented in the preceding background or the following detailed description.

As depicted, process flow lines in the figures can be referred to, interchangeably, as, e.g., lines, pipes, branches, distributors, streams, effluents, feeds, products, portions, catalysts, withdrawals, recycles, suctions, discharges, and caustics.

As used herein, the term "zone" can refer to an area including one or more equipment items and/or one or more sub-zones. Equipment items can include one or more reactors or reactor vessels, heaters, exchangers, pipes, pumps, compressors, and controllers. Additionally, an equipment item, such as a reactor, dryer, or vessel, can further include one or more zones or sub-zones.

As used herein, the term "stream" can include various hydrocarbon molecules and other substances. Moreover, the term "stream comprising Cx hydrocarbons" can include a stream comprising hydrocarbon with "x" number of carbon atoms, suitably a stream with a majority of hydrocarbons with "x" number of carbon atoms and preferably a stream with at least 75 wt % hydrocarbon molecules, respectively, with "x" number of carbon atoms. Moreover, the term "stream comprising Cx+ hydrocarbons" can include a stream comprising a majority of hydrocarbon molecules, with more than or equal to "x" carbon atoms and suitably less than 10 wt % and preferably less than 1 wt % hydrocarbon molecules, with x−1 carbon atoms. Lastly, the term "Cx− stream" can include a stream comprising a majority of hydrocarbon molecules with less than or equal to "x" carbon atoms and suitably less than 10 wt % and preferably less than 1 wt % hydrocarbon molecules, with x+1 carbon atoms.

The term "column" means a distillation column or columns for separating one or more components of different volatilities. Unless otherwise indicated, each column includes a condenser on an overhead of the column to condense the overhead vapor and reflux a portion of an overhead stream back to the top of the column. Also included is a reboiler at a bottom of the column to vaporize and send a portion of a bottom stream back to the bottom of the column to supply fractionation energy. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column.

As used herein, the term "overhead stream" can mean a stream withdrawn at or near a top of a vessel, such as a column.

As used herein, the term "bottoms stream" can mean a stream withdrawn at or near a bottom of a vessel, such as a column.

As used herein, the term "predominantly" can mean an amount of generally at least about 75%, preferably about 85%, and optimally about 95%, by mole, of a compound or class of compounds in a stream.

As used herein, the term "rich" can mean an amount of generally at least about 90%, preferably about 95%, and optimally about 99%, by mole, of a compound or class of compounds in a stream.

An exemplary embodiment of the process and apparatus for isomerizing hydrocarbons is addressed with reference to a process and apparatus 100 according to an embodiment as shown in FIG. 1. The process and apparatus 100 includes a hydrotreating unit 110, a stripper 120, an isomerization zone 130, a stabilizer column 140, a deisohexanizer column 150, a net gas scrubber 160, an off-gas compressor unit 170 and an absorber column 180.

In accordance with an exemplary embodiment as shown in FIG. 1, a hydrocarbon feed stream in line 102 is passed to the hydrotreating unit 110. The hydrocarbon feed stream is a feed stream comprising at least one of $C_5$, $C_6$ and $C_{7+}$ hydrocarbons. In an exemplary embodiment as shown in FIG. 1, the hydrocarbon feed stream is a light naphtha stream and predominantly comprises $C_5$, $C_6$ and $C_7$ hydrocarbons. Accordingly, the hydrotreating unit 110 is a light naphtha hydrotreating unit. A hydrotreating effluent in 112 is withdrawn from the hydrotreating unit 110. As shown in the FIG. 1, the hydrotreating effluent is passed to the stripper 120 to provide a stripper overhead stream in line 122 comprising light ends and a stripper bottoms stream in line 124 comprising $C_5$-$C_7$ hydrocarbons. The stripper overhead stream is condensed and passed to an overhead receiver 123 to obtain an off-gas stream in line 125 and a receiver bottoms stream in line 127 comprising LPG. A portion of the receiver bottoms stream is recycled back to the stripper 120 as reflux (not shown).

The stripper bottoms stream in line 124 is split to provide a first portion of the stripper bottoms stream in line 126 and a second portion of the stripper bottoms stream in line 128. The first portion of the stripper bottoms stream is passed to the isomerization zone 130 for isomerization in the presence of an isomerization catalyst and hydrogen in an isomerization zone under isomerization conditions to produce an isomerized stream in line 132. As shown, a hydrogen make-up gas stream in line 192 is passed to the isomerization zone 130. Additionally, a de-isohexanizer side draw stream in line 156 comprising cyclo-hexanes, linear hexane, cyclic hydrocarbons and monomethyl-branched pentane, from the de-isohexanizer column 150 is also passed to the isomerization zone 130.

The isomerization zone 130 may include one or more reactors. The isomerization zone can operate at any suitable temperature, such as a temperature of about 90° C. to about 235° C., preferably about 110° C. to about 205° C., and the pressure can be about 700 to about 7,000 KPa. The liquid hourly space velocities may range from about 0.5 to about 12 $hr^{-1}$. The catalyst used in the isomerization zone may include a strong acid catalyst, such as at least one of a chlorided platinum alumina, a crystalline aluminosilicate or zeolite, a sulfated zirconia, and a modified sulfated zirconia, preferably at least one of a chlorided platinum alumina or a sulfated zirconia. As a class, the crystalline aluminosilicate or crystalline zeolite catalyst may include a crystalline zeolitic molecular sieve having an apparent pore diameter large enough to adsorb neopentane. Generally, the catalyst may have a silica alumina molar ratio $SiO_2$:$Al_2O_3$ of greater than about 3:1 and less than about 60:1, and preferably about 15:1 to about 30:1. Catalysts of this type for isomerization and methods for preparation are disclosed in, e.g., U.S. Pat. No. 7,223,898.

The isomerized stream in line 132 may be passed to a stabilizer column 140 to provide a stabilizer off-gas stream in line 142 comprising $C_4$– hydrocarbons and a stabilizer bottoms stream i.e. liquid isomerate stream in line 144 comprising branched hydrocarbons. The liquid isomerate stream in line 144 may be passed to the de-isohexanizer column 150 to provide an isomerate product. A de-isohexanizer overhead stream in line 152, the de-isohexanizer side draw stream in line 156 and a de-isohexanizer bottoms stream in line 154 may be withdrawn from the de-isohexanizer column. The de-isohexanizer overhead stream in line 152 and de-isohexanizer bottoms stream in line 154 may be mixed to provide the isomerate product in line 158. Further, as discussed above, the de-isohexanizer side-draw stream may be passed to the isomerization zone 130.

Referring back to the stabilizer off-gas stream in line 142, the stabilizer off-gas stream may be passed to the net-gas scrubber 160 to obtain a net gas scrubber off-gas stream in line 162 comprising hydrogen and $C_1$-$C_4$ hydrocarbons. The net-gas scrubber 160 contacts the stabilizer off-gas stream with a suitable treatment solution for neutralizing and/or removing acidic components that may have originated with the chloride addition to the isomerization zone and may be present in the gas stream. Typically, the treatment solution will be a caustic. Spent caustic is withdrawn and fresh caustic is added to the net-gas scrubber 160. After treatment in the net-gas scrubber 160, the net gas scrubber off-gas stream is removed via line 162.

Subsequently, the net gas scrubber off-gas stream may be contacted with the second portion of the stripper bottoms stream in line 128 in the absorber column 180 to provide an absorber overhead stream in line 182 rich in hydrogen and an absorber bottoms stream in line 184 comprising light ends. The absorber bottoms stream further comprises absorber feed components i.e. the second portion of the stripper bottoms stream which is being used to extract the light ends from the net gas scrubber off-gas stream. The absorber column comprises about 10 to about 20 tray column/packed bed without any reboiler or condenser and may have an operating pressure of about 1400 Kpa(g) to about 2200 Kpa(g).

As shown in FIG. 1, the net gas scrubber off-gas stream in line 162 is passed to the compressor unit 170. The off-gas compressor unit 170 may comprise a suction knockout drum, an off-gas compressor, a discharge cooler and a discharge knockout drum. In an embodiment, the compressor unit may be a booster compressor. Accordingly, the net-gas scrubber off gas stream may be passed to the booster compressor before being passed, via line 172, to the absorber column 180 for the contacting step. The booster compressor is required to increase the net-gas scrubber off gas stream pressure from about 600 Kpa(g) to about 1200 Kpa(g) to the absorber operating pressure of about 1400 Kpa(g) to about 2200 Kpa(g). In a specific embodiment, the booster compressor may increase the pressure of the net-gas scrubber off gas stream from about 900 Kpa (g) to about 1900 Kpa (g).

In an embodiment, the second portion of the stripper bottoms stream is about 10 to about 30 wt %, or about 10 to about 20 wt %, of the stripper bottoms stream. The absorber overhead stream in line 182 is mixed with the stream in line 192 and passed to the isomerization zone as make-up hydrogen. The absorber bottoms stream in line 184 comprising light ends is passed to the stripper to recover $C_3$ and $C_4$ hydrocarbons such as LPG via stream 127.

Figure 2:
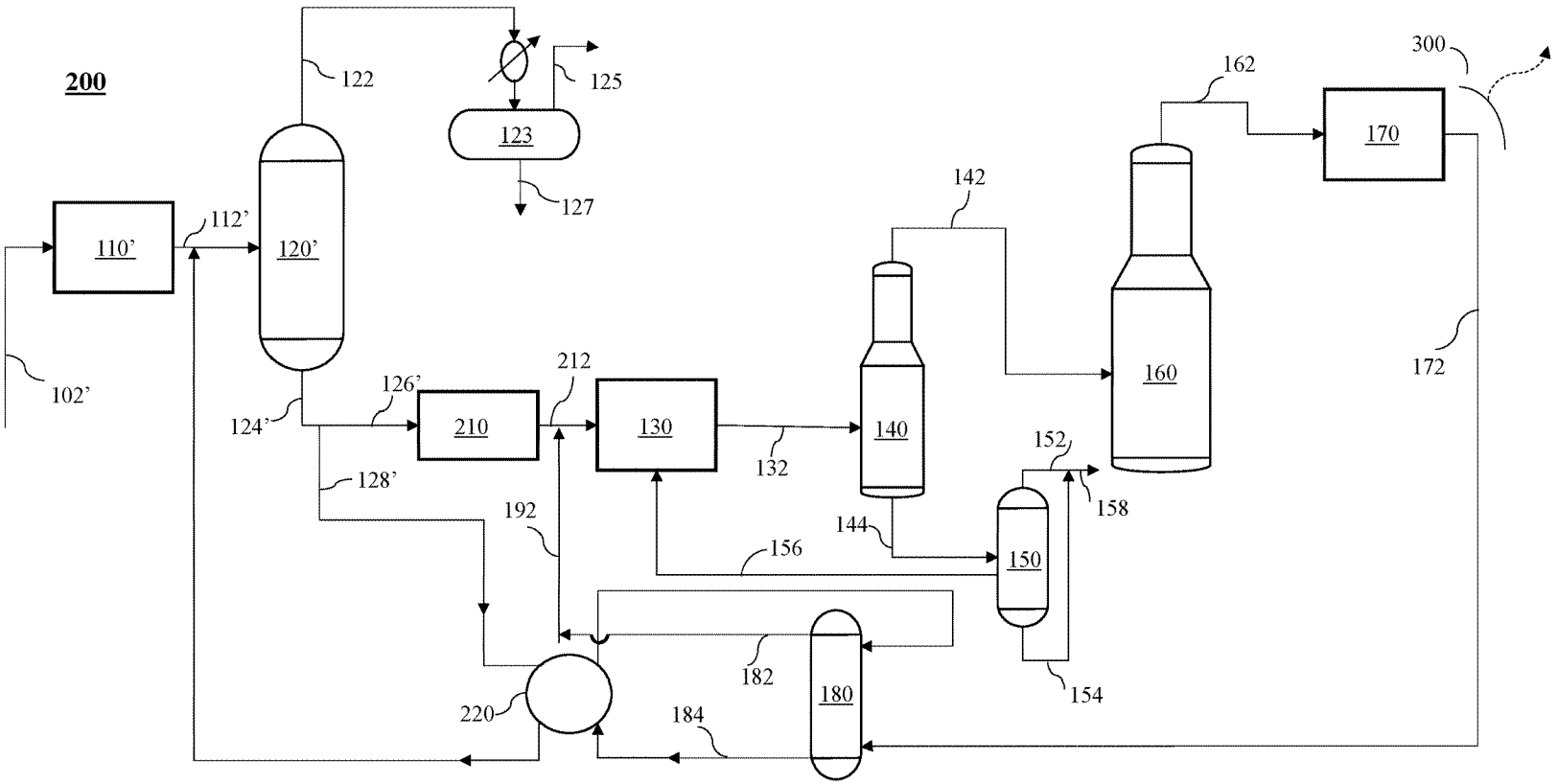
FIG. 2 is a schematic diagram of a process and an apparatus for isomerizing hydrocarbons in accordance with an exemplary embodiment.

Turning now to FIG. 2, another exemplary embodiment of the process and apparatus for isomerizing hydrocarbons is addressed with reference to a process and apparatus 200. Many of the elements in the FIG. 2 have the same configuration as in FIG. 1 and bear the same respective reference number and have similar operating conditions. Elements in FIG. 2 that correspond to elements in FIG. 1 but have a different configuration bear the same reference numeral as in FIG. 1 but are marked with a prime symbol (').) The apparatus and process in FIG. 2 are the same as in FIG. 1 with the exception of the noted following differences. In accordance with the exemplary embodiment as shown in the FIG. 2, a hydrocarbon feed stream in line 102' is a straight run naphtha feed comprising predominantly $C_5$-$C_{12}$ hydrocarbons. Accordingly, in the instant embodiment as discussed, the hydrotreating unit 110 is a straight run naphtha hydrotreating unit 110' to provide a heavy naphtha hydrotreating effluent in line 112'. A hydrotreating effluent in 112' is withdrawn from the hydrotreating unit 110'. As shown in the FIG. 1, the hydrotreating effluent is passed to the stripper 120' to provide a stripper overhead stream in line 122 comprising light ends and a stripper bottoms stream in line 124' comprising $C_5$-$C_{12}$ hydrocarbons.

The stripper bottoms stream in line 124 is split to provide a first portion of the stripper bottoms stream in line 126' and a second portion of the stripper bottoms stream in line 128'. In the instant embodiment, the second portion of the stripper bottoms stream is about 5 to about 20 wt % of the stripper bottoms stream. The first portion of the stripper bottoms stream is passed to a naphtha splitter column 210 to provide a hydrocarbon feed stream in line 212 comprising $C_5$-$C_7$ hydrocarbons and a $C_{7+}$ hydrocarbon stream (not shown). The hydrocarbon feed stream in line 212 is isomerized in the presence of an isomerization catalyst and hydrogen in the isomerization zone 130 under isomerization conditions to produce an isomerized stream in line 132 which is processed further as described in FIG. 1.

The second portion of the stripper bottoms stream may be passed to the absorber column 180 for contacting with the net gas scrubber off-gas stream to provide an absorber overhead stream in line 182 rich in hydrogen and an absorber bottoms stream in line 184 comprising light ends. In an exemplary embodiment as shown in FIG. 2, the second portion of the stripper bottoms stream may be passed to a heat exchanger 220 to cool the second portion via heat exchange with the absorber bottoms stream before being passed to the absorber column 180 for the contacting step. Rest of process is similar as described in FIG. 1.

Any of the above lines, conduits, units, devices, vessels, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect. The figures shows the above categorically as 300.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein. The figures shows the above categorically as 300.

Applicants have found that using the proposed flow scheme allows recovery of greater than about 98% of hydrogen from the net gas scrubber off-gas stream going to the fuel gas header and reduces the makeup hydrogen consumption by the same amount. The amount of hydrogen recovery for a medium to large size unit can be significantly high. As shown in the flow-schemes above, the absorber column, as proposed in the instant schemes, absorbs light ends ($C_1$ to $C_4$) from a net gas scrubber off-gas stream using a liquid absorbing medium. The overhead vapor stream from the absorber is hydrogen rich and hence can be used as a make-up gas as shown in the above flow schemes.

Table 1 illustrates the absorber column operating data, incoming streams to the absorber column and outgoing streams from the absorber column in accordance with an exemplary embodiment, wherein the isomerization unit has a fresh feed rate of around 8500 BPSD. As evident from Table 1, the overhead stream obtained from the absorber column has a hydrogen recovery of 98 mole % and a purity of about 89 mole %. The instant flow scheme results in savings of 1.71 MMUSD/year.

TABLE 1

| | Value | Unit |
|---|---|---|
| Absorber Operating Pressure | 1900 | Kpa(g) |
| Absorber Operating Temperature | 38 | ° C. |
| In Streams to the Absorber | | |
| Off Gas to Absorber (100%) | 1910 | kg/hr |
| Off Gas $H_2$ Purity | 56% | mole % |

TABLE 1-continued

| | Value | Unit |
|---|---|---|
| Liquid Feed to Absorber (15% of isomerization Feed) | 5500 | kg/hr |
| Out Streams from Absorber | | |
| High $H_2$ Purity Gas from Absorber Top, Stream | 325 | kg/hr |
| Hydrogen Purity of Gas from Absorber Top stream | 89% | mole % |
| $H_2$ Recovery from Absorber | 98% | mole % |
| $Hydrogen_2$ Saving per Year | 1.71 | MMUSD/year |
| Additional Equipment Payback Time | 28 | Months |

Specific Embodiments

While the following is described in conjunction with specific embodiments, it will be understood that this description is intended to illustrate and not limit the scope of the preceding description and the appended claims.

While the following is described in conjunction with specific embodiments, it will be understood that this description is intended to illustrate and not limit the scope of the preceding description and the appended claims.

A first embodiment of the invention is a process for isomerizing a hydrocarbon feed stream comprising at least one of $C_5$ to $C_7$ hydrocarbons, wherein the process comprises a) isomerizing the hydrocarbon feed stream in the presence of an isomerization catalyst and hydrogen in an isomerization zone under isomerization conditions to produce an isomerized stream; b) stabilizing the isomerized stream in a stabilizer column to provide a stabilizer off-gas stream and a liquid isomerate stream; c) passing the stabilizer off gas stream to a net-gas scrubber to obtain a net gas scrubber off-gas stream comprising hydrogen and $C_1$-$C_4$ hydrocarbons; d) contacting the net gas scrubber off-gas stream with an absorber liquid feed comprising $C_5$ to $C_7$ hydrocarbons in an absorber column to provide an absorber overhead stream comprising predominantly hydrogen and an absorber bottoms stream comprising light ends, the light ends comprising $C_1$-$C_4$ hydrocarbons; and e) passing the absorber overhead stream to the isomerization zone as make-up hydrogen. An embodiment of the invention is one, any or all of prior embodiments in this paragraph up through the first embodiment in this paragraph further comprising a) passing a light naphtha stream to a light naphtha hydrotreating unit to obtain a hydrotreating effluent; b) passing the hydrotreating effluent to a stripper to provide a stripper overhead stream comprising light ends and a stripper bottoms stream comprising $C_5$-$C_7$ hydrocarbons; wherein the absorber liquid feed comprises at least a portion of the stripper bottoms stream and the remaining portion of the stripper bottoms stream being the hydrocarbon feed stream. An embodiment of the invention is one, any or all of prior embodiments in this paragraph up through the first embodiment in this paragraph, wherein about 10 to about 30 wt % of the stripper bottoms stream is passed to the absorber column as the absorber liquid feed. An embodiment of the invention is one, any or all of prior embodiments in this paragraph up through the first embodiment in this paragraph further comprising passing the absorber bottoms stream comprising light ends to the stripper to recover $C_3$ and $C_4$ hydrocarbons. An embodiment of the invention is one, any or all of prior embodiments in this paragraph up through the first embodiment in this paragraph further comprising passing the net-gas scrubber off gas stream to a booster compressor before being passed to the absorber column for the contacting step. An embodiment of the invention is one, any or all of prior embodiments in this paragraph up through the first embodiment in this paragraph further comprising a) passing a straight run naphtha feed to a straight run naphtha hydrotreating unit to provide a straight run naphtha hydrotreating effluent; b) passing the straight run naphtha hydrotreating effluent to a stripper to provide a stripper overhead stream comprising light ends and a stripper bottoms stream comprising $C_5$-$C_7$ and $C_{7+}$ hydrocarbons; wherein the absorber liquid feed comprises at least a portion of the stripper bottoms stream. An embodiment of the invention is one, any or all of prior embodiments in this paragraph up through the first embodiment in this paragraph further comprising passing a remaining portion of the stripper bottoms stream to a naphtha splitter column to provide the hydrocarbon feed stream comprising $C_5$-$C_7$ hydrocarbons and a $C_{7+}$ hydrocarbon stream. An embodiment of the invention is one, any or all of prior embodiments in this paragraph up through the first embodiment in this paragraph further comprising cooling the at least a portion of the stripper bottoms stream via heat exchange with the absorber bottoms stream before being passed to the absorber column for the contacting step. An embodiment of the invention is one, any or all of prior embodiments in this paragraph up through the first embodiment in this paragraph further comprising passing the liquid isomerate stream to a de-isohexanizer column to provide a de-isohexanizer side draw stream and an isomerate product. An embodiment of the invention is one, any or all of prior embodiments in this paragraph up through the first embodiment in this paragraph, further comprising at least one of sensing at least one parameter of the process for isomerizing a hydrocarbon feed stream and generating a signal or data from the sensing; generating and transmitting a signal; or generating and transmitting data.

A second embodiment of the invention is a process for isomerizing a light naphtha stream, wherein the process comprises a) passing the light naphtha stream to a light naphtha hydrotreating unit to obtain a hydrotreating effluent; b) passing the hydrotreating effluent to a stripper to provide a stripper overhead stream comprising light ends and a stripper bottoms stream comprising $C_5$-$C_7$ hydrocarbons; c) isomerizing a first portion of the stripper bottoms stream in the presence of an isomerization catalyst and hydrogen in an isomerization zone under isomerization conditions to produce an isomerized stream; d) stabilizing the isomerized stream in a stabilizer column to provide a stabilizer off-gas stream and a liquid isomerate stream; e) passing the stabilizer off gas stream to a net-gas scrubber to obtain a net gas scrubber off-gas stream comprising hydrogen and $C_1$-$C_4$ hydrocarbons; f) contacting the net gas scrubber off-gas stream with a second portion of the stripper bottoms stream in an absorber column to provide an absorber overhead stream comprising predominantly hydrogen and an absorber bottoms stream comprising light ends; and g) passing the absorber overhead stream to the isomerization zone as make-up hydrogen. An embodiment of the invention is one, any or all of prior embodiments in this paragraph up through the second embodiment in this paragraph, wherein a second portion of the stripper bottoms stream is about 10 to about 30 wt % of the stripper bottoms stream. An embodiment of the invention is one, any or all of prior embodiments in this paragraph up through the second embodiment in this paragraph further comprising passing the absorber bottoms stream comprising light ends to the stripper to recover $C_3$ and $C_4$ hydrocarbons. An embodiment of the invention is one, any or all of prior embodiments in this paragraph up through the second embodiment in this paragraph further comprising passing the liquid isomerate stream to a de-isohexanizer column to provide a de-isohexanizer side draw stream and an isomerate product. An embodiment of the invention is one, any or all of prior embodiments in this paragraph up through the second embodiment in this paragraph further comprising passing the net-gas scrubber off gas stream to a booster compressor before being passed to the absorber column for the contacting step.

A third embodiment of the invention is a process for isomerizing a straight run naphtha stream, wherein the process comprises a) passing a straight run naphtha feed to a straight run naphtha hydrotreating unit to provide a heavy naphtha hydrotreating effluent; b) passing the straight run naphtha hydrotreating effluent to a stripper to provide a stripper overhead stream comprising light ends and a stripper bottoms comprising $C_5$-$C_7$ and $C_{7+}$ hydrocarbons; c) passing a first portion of the stripper bottoms stream to a naphtha splitter column to provide a hydrocarbon feed stream comprising $C_5$-$C_7$ hydrocarbons and a $C_{7+}$ hydrocarbon stream. d) isomerizing the hydrocarbon feed stream in the presence of an isomerization catalyst and hydrogen in an isomerization zone under isomerization conditions to produce an isomerized stream; e) stabilizing the isomerized stream in a stabilizer column to provide a stabilizer off-gas stream and a liquid isomerate stream; f) passing the stabilizer off gas stream to a net-gas scrubber to obtain a net gas scrubber off-gas stream comprising hydrogen and $C_1$-$C_4$ hydrocarbons; g) contacting the net gas scrubber off-gas stream with a second portion of the stripper bottoms stream in an absorber column to provide an absorber overhead stream comprising predominantly hydrogen and an absorber bottoms stream comprising light ends; and h) passing the absorber overhead stream to the isomerization zone as make-up hydrogen. An embodiment of the invention is one, any or all of prior embodiments in this paragraph up through the third embodiment in this paragraph, wherein the second portion of the stripper bottoms stream is about 5 to about 20 wt % of the stripper bottom stream. An embodiment of the invention is one, any or all of prior embodiments in this paragraph up through the third embodiment in this paragraph further comprising passing the absorber bottoms stream comprising light ends to the stripper to recover $C_3$ and $C_4$ hydrocarbons. An embodiment of the invention is one, any or all of prior embodiments in this paragraph up through the third embodiment in this paragraph further comprising cooling the second portion of the stripper bottoms stream via heat exchange with the absorber bottoms stream before being passed to the absorber column for the contacting step. An embodiment of the invention is one, any or all of prior embodiments in this paragraph up through the third embodiment in this paragraph further comprising passing the net-gas scrubber off gas stream to a booster compressor before being passed to the absorber column for the contacting step.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Fahrenheit and, all parts and percentages are by weight, unless otherwise indicated.

The invention claimed is:

1. A process for isomerizing a hydrocarbon feed stream comprising at least one of C5 to C7 hydrocarbons, wherein the process comprises:

a) separating a hydrocarbon stream in a stripper to provide a stripper overhead stream comprising light ends and a stripper bottoms stream comprising C5-C7 hydrocarbons;

b) isomerizing a hydrocarbon feed stream in the presence of an isomerization catalyst and hydrogen in an isomerization zone under isomerization conditions to produce an isomerized stream, wherein the hydrocarbon feed stream comprises a first portion of the stripper bottoms stream;

c) stabilizing the isomerized stream in a stabilizer column to provide a stabilizer off-gas stream and a liquid isomerate stream;

d) passing the stabilizer off gas stream to a net-gas scrubber to obtain a net gas scrubber off-gas stream comprising hydrogen and C1-C4 hydrocarbons;

e) contacting the net gas scrubber off-gas stream with an absorber liquid feed comprising C5 to C7 hydrocarbons in an absorber column to provide an absorber overhead stream comprising predominantly hydrogen and an absorber bottoms stream comprising light ends, the light ends comprising C1-C4 hydrocarbons, wherein the absorber liquid feed comprises a second portion of the stripper bottoms stream and wherein the second portion of the stripper bottoms stream is cooled via heat exchange with the absorber bottoms stream before being passed to the absorber column for the contacting step; and f) passing the absorber overhead stream to the isomerization zone as make-up hydrogen.

2. The process of claim 1, further comprising:

a) passing a light naphtha stream to a light naphtha hydrotreating unit to obtain a hydrotreating effluent; and b) passing the hydrotreating effluent to the stripper to be separated into the stripper overhead stream and the stripper bottoms stream.

3. The process of claim 2, wherein the second portion of the stripper bottoms stream that is passed to the absorber column as the absorber liquid feed comprises about 10 to about 30 wt % of the stripper bottoms stream.

4. The process of claim 1, further comprising passing the absorber bottoms stream comprising light ends to the stripper to recover C3 and C4 hydrocarbons.

5. The process of claim 1, further comprising passing the net-gas scrubber off gas stream to a booster compressor before being passed to the absorber column for the contacting step.

6. The process of claim 1, further comprising:

a) passing a straight run naphtha feed to a straight run naphtha hydrotreating unit to provide a straight run naphtha hydrotreating effluent; and b) passing the straight run naphtha hydrotreating effluent to the stripper to be separated into the stripper overhead stream and the stripper bottoms stream.

7. The process of claim 6, further comprising:

passing the first portion of the stripper bottoms stream to a naphtha splitter column to provide the hydrocarbon feed stream comprising C5-C7 hydrocarbons and a C7+ hydrocarbon stream.

8. The process of claim 1, further comprising passing the liquid isomerate stream to a de-isohexanizer column to provide a de-isohexanizer side draw stream and an isomerate product.

9. The process of claim 1, further comprising at least one of:

sensing at least one parameter of the process for isomerizing a hydrocarbon feed stream and generating a signal or data from the sensing;

generating and transmitting a signal; or generating and transmitting data.

10. A process for isomerizing a light naphtha stream, wherein the process comprises:

a) passing the light naphtha stream to a light naphtha hydrotreating unit to obtain a hydrotreating effluent;

b) passing the hydrotreating effluent to a stripper to provide a stripper overhead stream comprising light ends and a stripper bottoms stream comprising C5-C7 hydrocarbons;

c) isomerizing a first portion of the stripper bottoms stream in the presence of an isomerization catalyst and hydrogen in an isomerization zone under isomerization conditions to produce an isomerized stream;

d) stabilizing the isomerized stream in a stabilizer column to provide a stabilizer off-gas stream and a liquid isomerate stream;

e) passing the stabilizer off gas stream to a net-gas scrubber to obtain a net gas scrubber off-gas stream comprising hydrogen and C1-C4 hydrocarbons;

f) contacting the net gas scrubber off-gas stream with a second portion of the stripper bottoms stream in an absorber column to provide an absorber overhead stream comprising predominantly hydrogen and an absorber bottoms stream comprising light ends;

g) cooling the second portion of the stripper bottoms stream via heat exchange with the absorber bottoms stream before being passed to the absorber column for the contacting step; and h) passing the absorber overhead stream to the isomerization zone as make-up hydrogen.

11. The process of claim 10, wherein the second portion of the stripper bottoms stream is about 10 to about 30 wt % of the stripper bottoms stream.

12. The process of claim 10, further comprising passing the absorber bottoms stream comprising light ends to the stripper to recover C3 and C4 hydrocarbons.

13. The process of claim 10, further comprising passing the liquid isomerate stream to a de-isohexanizer column to provide a de-isohexanizer side draw stream and an isomerate product.

14. The process of claim 10, further comprising passing the net-gas scrubber off gas stream to a booster compressor before being passed to the absorber column for the contacting step.

15. A process for isomerizing a straight run naphtha stream, wherein the process comprises:

a) passing a straight run naphtha feed to a straight run naphtha hydrotreating unit to provide a heavy naphtha hydrotreating effluent;

b) passing the straight run naphtha hydrotreating effluent to a stripper to provide a stripper overhead stream comprising light ends and a stripper bottoms comprising C5-C7 and C7+ hydrocarbons;

c) passing a first portion of the stripper bottoms stream to a naphtha splitter column to provide a hydrocarbon feed stream comprising C5-C7 hydrocarbons and a C7+ hydrocarbon stream;

d) isomerizing the hydrocarbon feed stream in the presence of an isomerization catalyst and hydrogen in an isomerization zone under isomerization conditions to produce an isomerized stream;

e) stabilizing the isomerized stream in a stabilizer column to provide a stabilizer off-gas stream and a liquid isomerate stream;

f) passing the stabilizer off gas stream to a net-gas scrubber to obtain a net gas scrubber off-gas stream comprising hydrogen and C1-C4 hydrocarbons;

g) contacting the net gas scrubber off-gas stream with a second portion of the stripper bottoms stream in an absorber column to provide an absorber overhead stream comprising predominantly hydrogen and an absorber bottoms stream comprising light ends;

h) passing the absorber overhead stream to the isomerization zone as make-up hydrogen; and, i) cooling the second portion of the stripper bottoms stream via heat exchange with the absorber bottoms stream before being passed to the absorber column for the contacting step.

16. The process of claim 15, wherein the second portion of the stripper bottoms stream is about 5 to about 20 wt % of the stripper bottom stream.

17. The process of claim 15, further comprising passing the absorber bottoms stream comprising light ends to the stripper to recover C3 and C4 hydrocarbons.

18. The process of claim 15, further comprising passing the net-gas scrubber off gas stream to a booster compressor before being passed to the absorber column for the contacting step.

* * * * *